US006811450B1

(12) United States Patent
Data et al.

(10) Patent No.: US 6,811,450 B1
(45) Date of Patent: Nov. 2, 2004

(54) ELECTRICAL RECEPTACLE-TYPE TERMINAL

(75) Inventors: Mark M. Data, Bolingbrook, IL (US); Arvind Patel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/445,864

(22) Filed: May 27, 2003

(51) Int. Cl.[7] ..... H01R 13/432
(52) U.S. Cl. ..... 439/748; 439/181; 439/850
(58) Field of Search ..... 439/748, 850–852, 439/88, 181, 520, 745, 857, 854–855

(56) References Cited

U.S. PATENT DOCUMENTS

| | | | | |
|---|---|---|---|---|
| 4,947,115 A | | 8/1990 | Siemon et al. | 324/158 |
| 5,145,422 A | | 9/1992 | Fry | 439/856 |
| 5,549,483 A | | 8/1996 | Hotea | 439/399 |
| 6,066,007 A | | 5/2000 | Huang | 439/748 |
| 6,120,333 A | | 9/2000 | Ko | 439/748 |
| 6,183,309 B1 | * | 2/2001 | Chiang | 439/687 |
| 6,280,250 B1 | | 8/2001 | Ko | 439/595 |
| 6,464,547 B2 | | 10/2002 | Ketelsleger | 439/851 |
| 6,478,635 B2 | * | 11/2002 | Charles et al. | 439/851 |

* cited by examiner

*Primary Examiner*—Hae Moon Hyeon
(74) *Attorney, Agent, or Firm*—Stephen Z. Weiss

(57) ABSTRACT

An electrical receptacle terminal is provided for receiving a mating terminal pin. The terminal includes a front mating end, a rear terminating end and a generally U-shaped base portion between the ends. The base portion includes a base wall, a pair of continuous and solid side walls projecting upwardly from the base wall and a pair of contact arms projecting upwardly from each side wall. The contact arms have opposing contact portions defining multiple contact points on each side of the U-shaped base portion for engaging the terminal pin inserted between the pairs of contact arms.

18 Claims, 2 Drawing Sheets

ELECTRICAL RECEPTACLE-TYPE TERMINAL

FIELD OF THE INVENTION

This invention generally relates to the art of electrical connectors and, particularly, to an electrical receptacle-type terminal for receiving a mating terminal pin.

BACKGROUND OF THE INVENTION

Generally, an electrical connector typically includes some form of insulating or dielectric housing which mounts one or more conductive terminals typically fabricated of metal material. The connector, itself, may be a receptacle or female connector for mating with a plug or male connector. The terminals can take a wide variety of configurations and are designed for establishing an electrical connection when the two connectors are mated. For instance, as in the instant application, one of the connectors may mount one or more receptacle-type terminals for receiving terminal pins of the other connector.

With the ever-increasing miniaturization of electrical connectors, the terminals of the connectors are becoming smaller and smaller. Correspondingly, the amount of metal used in the terminals also is significantly decreasing, notwithstanding the fact that requirements still must be made that the terminals can withstand significant buckling forces during insertion and also still provide sufficient normal contact forces on a terminal pin, for instance. The terminals also must have sufficient metal to avoid the creation of large amounts of resistive heat. All of these requirements create problems in designing electrical terminals, such as receptacle-type terminals, within the context of the ever-increasing miniaturization of the terminal sizes. The present invention is directed to solving these various problems including the provision of a receptacle-type terminal which can be quite small but still provide good normal contact forces on a terminal pin as well as providing a robust structure which has significant metal sections.

SUMMARY OF THE INVENTION

An object, therefore, of the invention is to provide a new and improved electrical receptacle-type terminal for receiving a mating terminal pin.

In the exemplary embodiment of the invention, the receptacle terminal is elongated and includes a front mating end, a rear terminating end and a generally U-shaped base portion between the ends. The base portion includes a base wall, a pair of continuous and solid side walls projecting upwardly from the base wall, and a pair of contact arms projecting upwardly from each side wall. The contact arms have opposing contact portions defining multiple contact points on each side of the U-shaped base portion for engaging a terminal pin inserted between the pairs of contact arms.

As disclosed herein, the contact arms of each pair thereof on each side of the U-shaped base portion are separated by a slot which extends upwardly from the respective solid side wall.

According to one aspect of the invention, a sacrificial contact portion is disposed above each side wall nearer to the mating end of the terminal than the contact arms. The sacrificial contact portions engage the inserted terminal pin before the pin reaches the contact arms. A flared mouth is located forwardly of the sacrificial contact portions for guiding the terminal pin therebetween.

According to another aspect of the invention, the front mating end of the terminal has a box-shape defined by a bottom wall which is coextensive with the base wall of the generally U-shaped base portion, a pair of side walls which are coextensive with the side walls of the base portion and a top wall located to define a platform for guiding the terminal pin between the contact arms.

According to a further aspect of the invention, a box-shaped support section is located behind the contact arms and is defined by a bottom wall which is coextensive with the base wall of the generally U-shaped base portion, a pair of side walls which are coextensive with the side walls of the base portion and a top wall. The side walls of the support section are integral with one of the contact arms of each pair thereof on each opposite side of the base portion. The top wall is defined by inwardly bent tabs at the top edges of the side walls of the box-shaped support section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
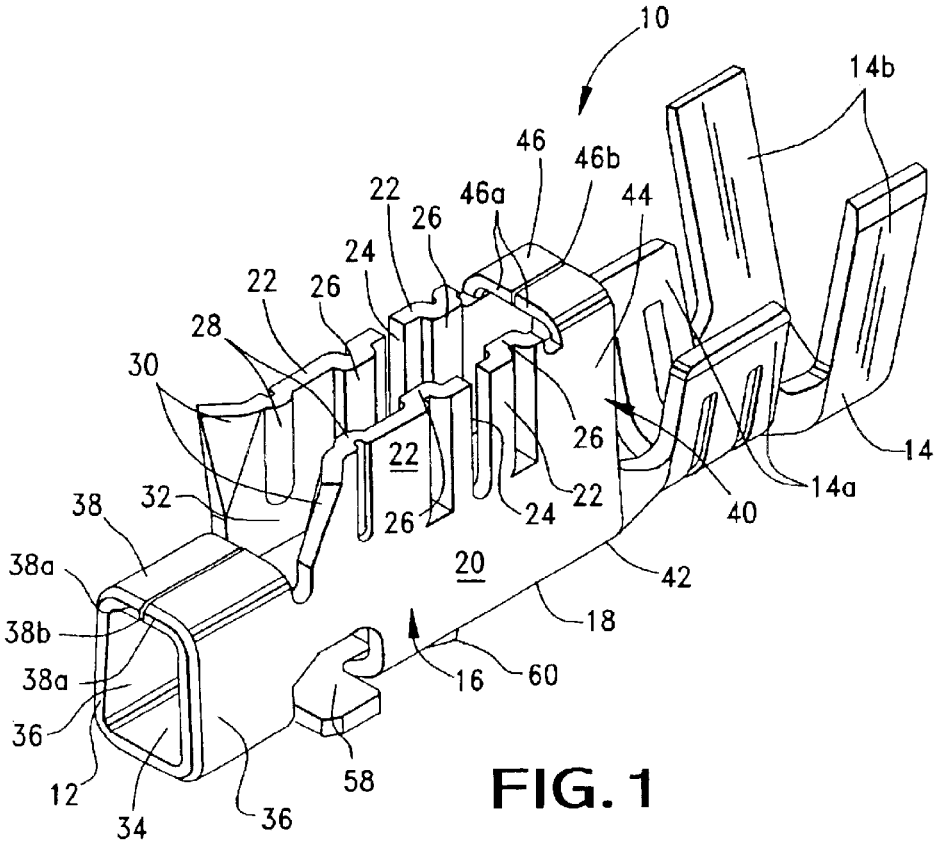
FIG. 1 is a perspective view of an electrical receptacle terminal embodying the concepts of the invention.

Referring to the drawings in greater detail, and first to FIG. 1, the invention is embodied in an elongated electrical receptacle terminal, generally designated 10. Typically, a plurality of such terminals will be mounted in a dielectric connector housing for receiving a terminal pin, as described hereinafter. Before proceeding, it should be understood that such terms as "upwardly", "downwardly", "top", "bottom" and the like herein and in the claims hereof are not in any way intended to be limiting in nature. These terms are used to present a clear and concise understanding of the invention as may be viewed in the drawings. Obviously, the terminal, itself, as well as the connector within which the terminal is mounted, is omni-directional in function and use.

With that understanding, and referring again to FIG. 1, receptacle terminal 10 includes a front mating end 12, a rear terminating end 14 and a generally U-shaped base portion, generally designated 16, located between the front mating end and the rear terminating end. Rear terminating end 14 is designed for terminating an electrical wire which has a center conductor or core surrounded by an outer insulating cover or cladding. Therefore, the rear terminating end 14 includes a pair of crimp arms 14*a* for clamping onto the conductor or core of the electrical wire. A second pair of crimp arms 14*b* are provided for clamping onto the outer insulation of the wire for strain relief purposes. Of course, receptacle terminal 10 can have a wide variety of terminating ends for termination to appropriate conductors to which the terminal is to be terminated.

The generally U-shaped base portion 16 of terminal 10 includes a flat base wall 18 and a pair of side walls 20 projecting upwardly from opposite edges of the flat base wall. It can be seen that side walls 20 are continuous and solid or uninterrupted to provide both a robust supporting structure as well as a significant metal area. A pair of contact arms 22 project upwardly from each side wall 20. The contact arms in each pair thereof are separated by a slot 24. Preferably, terminal 10 is stamped and formed from conductive sheet metal material, and an inwardly protruding contact portion 26 is stamped and formed from each contact arm 22. Generally, contact portions 26 define multiple contact points on each side of the U-shaped base portion 16 for engaging a terminal pin inserted between the pairs of contact arms 22. Specifically, four contact points are provided, two contact points on each opposite side of the base portion.

An inwardly protruding, sacrificial contact portion 28 is formed above each side wall 20 nearer to mating end 12 than contact arms 22. These sacrificial contact portions, thereby, are located for engaging an inserted terminal pin before the pin reaches contact arms 22 and the respective contact portions 26. Therefore, any electrical arcing between the terminal pin and terminal 10 will occur at sacrificial contact portions 28 so that any coating created on the terminal will be located at sacrificial contact portions 28 which, otherwise, would reduce electrical conductivity should the arcing and coating occur at contact portions 26 of contact arms 22. Outwardly flared portions 30 define a flared mouth 32 for guiding the terminal pin between sacrificial contact portions 28.

Front mating end 12 of terminal 10 is provided with a box-shape defined by a flat bottom wall 34 which is coextensive with base wall 18 of the generally U-shaped base portion 16, as well as a pair of side walls 36 which are coextensive with side walls 20 of base portion 16. The box-shaped front mating end includes a top wall 38 which is defined by inwardly bent tabs 38*a* which join at a seam 38*b*. Top wall 38 is located to define a platform for guiding the terminal pin between sacrificial contact portions 28 and then between contact portions 26 of contact arms A box-shaped support section, generally designated 40, is located behind the U-shaped base portion 16. Support section 40 includes a flat bottom wall 42 which is coextensive with base wall 18 of the generally U-shaped base portion 16, as well as a pair of side walls 44 which are coextensive with side walls 20 of the base portion. Support section 40 includes a top wall 46 defined by a pair of inwardly bent tabs 46*a* which meet at a seam 46*b*.

As can be seen clearly in FIG. 1, base wall 18 of base portion 16, bottom wall 34 of mating end 12 and bottom wall 42 of support section 40 are coextensive or run continuously as a single wall lengthwise of terminal 10. Similarly, side walls 20 of base portion 16, side walls 36 of mating end 12 and side walls 44 of support section 40 are continuous walls running lengthwise of the terminal.

Figure 2:
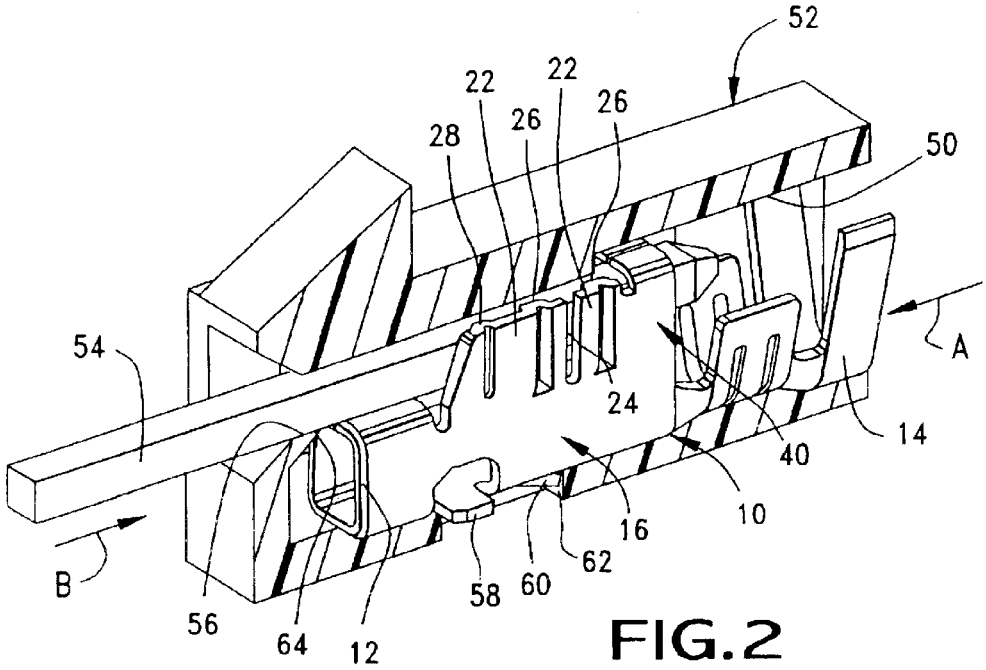
FIG. 2 shows the terminal mounted within an appropriate connector housing, with a terminal pin inserted therein.

FIG. 2 shows terminal 10 inserted in the direction of arrow "A" into a cavity 50 of a dielectric connector housing, generally designated 52. A terminal pin 54 is inserted in the direction of arrow "B" through a flared opening 56 in the housing and into engagement between contact portions 26 of contact arms 22 of the terminal, after the terminal pin has been inserted past and into engagement with sacrificial contact portions 28. A pair of stamped and formed wings 58 of the terminal abut against side walls (not visible in the drawing) of cavity 50 to stabilize the terminal within the cavity. An angled resilient latch tongue 60 is stamped and formed out of base wall 18 of the U-shaped base portion 16. When the terminal is inserted into the cavity in the direction of arrow "A", resilient latch tongue 60 is depressed and then "snappingly" released into engagement with a latch shoulder 62 on housing 52 to lock the terminal in the fully inserted position as seen in FIG. 2, whereat front mating end 12 of the terminal abuts against an interior shoulder 64 of the housing.

Figure 3:
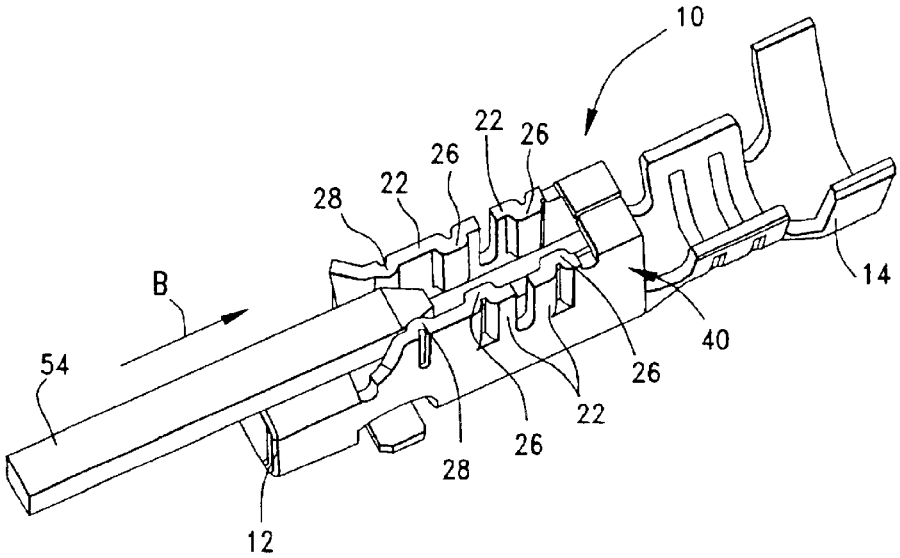
FIG. 3 is a perspective view of the terminal, with a terminal pin being inserted thereinto and into engagement with the sacrificial contact portions of the terminal.
Figure 4:
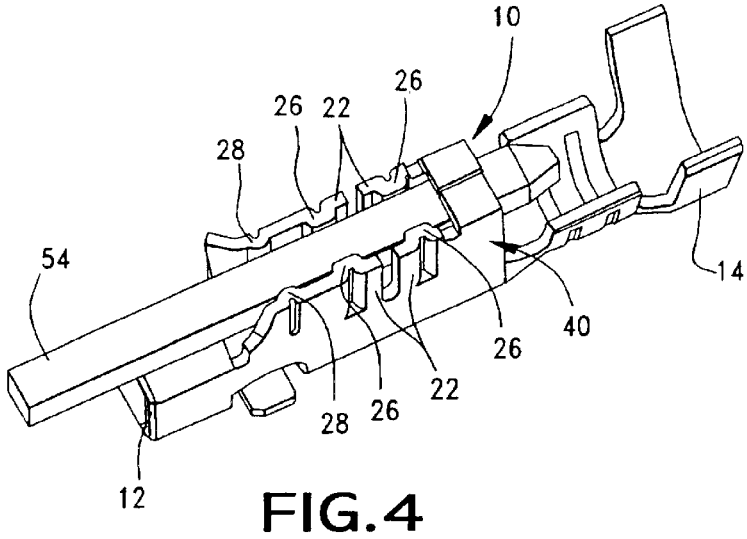
FIG. 4 is a view similar to that of FIG. 3, with the terminal pin fully inserted into the receptacle terminal.

FIG. 3 shows terminal pin 54 initially being inserted into receptacle terminal 10 whereby the tip of the terminal pin first engages sacrificial contact portions 28. If any electrical arcing is to occur between the terminal pin and terminal 10, the arcing will occur in response to this initial engagement with the sacrificial contact portions. During time, any coating of the terminal which occurs due to the arcing will be isolated at these sacrificial contact portions and will not adversely affect the primary contact portions 26. FIG. 4 shows terminal pin 54 fully inserted into terminal 10 corresponding to the position of FIG. 2. The terminal pin now is in engagement with all of the multiple contact portions 26 of contact arms 22 as well as sacrificial contact portions 28.

A few additional advantages of the invention will be mentioned at this point. Specifically, slots 24 between contact arms 28 provide for independent movement of the contact arms and, thereby, independent engagement of contact portions 26 with terminal pin 54. This redundancy ensures a good electrical connection between terminal pin 54 and terminal 10. A long and continuous wall means is provided beneath slots 24 by side walls 20, 36 and 44 of base portion 16, mating end 12 and support section 40, respectively. These large and continuous side walls provide significant metal and structural support to prevent buckling of the terminal as it is inserted into connector housing 52. This significant area are also allows a large current to pass without the creation of excessive heat due to current resistance. This is important when terminal 10 is used as a power terminal. Because of the significant metal area, heat is readily dissipated. Box-shaped mating end 12 and box-shaped support section 40 at opposite ends of the generally U-shaped base portion 16 add significant structural rigidity to the terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical receptacle terminal for receiving a mating terminal pin, comprising:

a front mating end;

a rear terminating end; and a generally U-shaped base portion between said ends and including a base wall, a pair of continuous and solid side walls projecting upwardly from the base wall, and a pair of contact arms projecting upwardly from each side wall, the contact arms having opposing contact portions defining multiple contact points on each side of the U-shaped base portion for engaging a terminal pin inserted between the pairs of contact arms and a sacrificial contact portion above each side wall nearer to the mating end of the terminal than to said contact arms for engaging the inserted terminal pin before the pin reaches said contact arms.

2. The electrical receptacle terminal of claim 1 wherein the contact arms of each pair thereof on each side of the U-shaped base portion are separated by a slot which extends upwardly from the respective solid side wall.

3. The electrical receptacle terminal of claim 1, including a flared mouth forwardly of the sacrificial contact portions for guiding the terminal pin therebetween.

4. The electrical receptacle terminal of claim 1 wherein said front mating end of the terminal has a box-shape defined by a top wall, a bottom wall and a pair of side walls.

5. The electrical receptacle terminal of claim 4 wherein the bottom wall of said box-shaped mating end is coextensive with the base wall of said generally U-shaped base portion.

6. The electrical receptacle terminal of claim 5 wherein the side walls of said box-shaped mating end are coextensive with the side walls of said generally U-shaped base portion.

7. The electrical receptacle terminal of claim 4 wherein the top wall of said box-shaped mating end is located to define a platform for guiding the terminal pin between said contact arms.

8. The electrical receptacle terminal of claim 1, including a box-shaped support section behind said contact arms and defined by a top wall, a bottom wall and a pair of side walls.

9. The electrical receptacle terminal of claim 8 wherein the bottom wall of said box-shaped support section is coextensive with the base wall of said generally U-shaped base portion.

10. The electrical receptacle terminal of claim 9 wherein the side walls of said box-shaped support section are coextensive with the side walls of said generally U-shaped base portion.

11. The electrical receptacle terminal of claim 8 wherein the side walls of said box-shaped support section are integral with one of the contact arms of each pair thereof on each opposite side of the generally U-shaped base portion.

12. The electrical receptacle terminal of claim 11 wherein the top wall of said box-shaped support section is defined by inwardly bent tabs at top edges of the side walls of the box-shaped support section.

13. An electrical receptacle terminal for receiving a mating terminal pin, comprising:

a front mating end;

a rear terminating end; and a generally U-shaped base portion between said ends and including a base wall, a pair of continuous and solid side walls projecting upwardly from the base wall, a pair of contact arms projecting upwardly from each side wall, the contact arms of each pair thereof on each side of the U-shaped base portion being separated by a slot which extends upwardly from the respective solid side wall, the contact arms having opposing contact portions defining multiple contact points on each side of the U-shaped base portion for engaging a terminal pin inserted between the pairs of contact arms, said front mating end of the terminal having a box-shape defined by a bottom wall coextensive with the base wall of said base portion, a pair of side walls coextensive with the side walls of said base portion and a top wall located to define a platform for guiding the terminal pin between the contact arms, and a box-shaped support section behind the contact arms and defined by a bottom wall which is coextensive with the base wall of the base portion, a pair of side walls which are coextensive with the side walls of the base portion and a top wall.

14. The electrical receptacle terminal of claim 13 wherein the side walls of said box-shaped support section are integral with one of the contact arms of each pair thereof on each opposite side of the generally U-shaped base portion.

15. The electrical receptacle terminal of claim 13, including a sacrificial contact portion above each side wall of the U-shaped base portion nearer to the mating end of the terminal than to said contact arms for engaging the inserted terminal pin before the pin reaches said contact arms.

16. The electrical receptacle terminal of claim 15, including a flared mouth forwardly of the sacrificial contact portions for guiding the terminal pin therebetween.

17. The electrical receptacle terminal of claim 13 wherein the terminal is stamped and formed of conductive sheet metal material.

18. The electrical receptacle terminal of claim 13 wherein said rear terminating end includes at least one pair of crimp arms for clamping onto an electrical wire.

* * * * *